United States Patent [19]

Campbell et al.

[11] 4,440,321

[45] Apr. 3, 1984

[54] DEBRIS RECEPTACLE, COVER, AND CONTENTS COMPRESSOR AND DISCHARGE ASSEMBLY

[75] Inventors: Robert G. Campbell, Collingswood; Warren A. Campbell, III, Audubon, both of N.J.

[73] Assignee: Hilldale Enterprises, Annapolis, Md.

[21] Appl. No.: 389,451

[22] Filed: Jun. 16, 1982

[51] Int. Cl.[3] ..... B67D 5/32; B65D 90/00

[52] U.S. Cl. ..... 222/153; 222/386; 220/1 T; 220/93; 206/815

[58] Field of Search ..... 222/323, 326, 327, 386, 222/386.5, 153; 220/1 T, 68, 93, 94 A, 306, 409; 206/815

[56] References Cited

U.S. PATENT DOCUMENTS

| | | | |
|---|---|---|---|
| 381,553 | 4/1888 | Hollis | 222/386 |
| 2,587,683 | 3/1952 | Barry | 222/327 X |
| 3,063,591 | 11/1962 | Laginestra | 220/93 X |
| 3,854,582 | 12/1974 | Martinelli | 206/508 |
| 4,254,602 | 3/1981 | Boynton | 220/1 T X |
| 4,351,447 | 9/1982 | Graff | 220/306 |
| 4,390,110 | 6/1983 | Pirro | 220/1 T X |

*Primary Examiner*—Joseph J. Rolla
*Assistant Examiner*—Michael S. Huppert
*Attorney, Agent, or Firm*—Mason, Fenwick & Lawrence

[57] ABSTRACT

A receptacle and cover assembly for collecting lawn debris and the like and including structure for assisting transfer of compacted contents of the receptacle to expendable lawn trash bags and the like, comprising a main receptacle body section in the shape of an upwardly opening container having a skirt-like lower edge formation at the bottom of the receptacle body section for supporting it in upright position, and a removable cover member for the receptacle body section. The body section has a centrally open outer bottom wall portion extending inwardly from the side wall at a position spaced slightly above the lower edge formation providing a shelf-like ledge extending inwardly from the side wall, and a moveable bottom panel member forming a discharge assist piston which rests on shelf-like ledge formation and collectively therewith forms the bottom of the receptacle. The center opening in the bottom wall portion is large enough for passage of the operator's hand therethrough to manually engage and force the bottom panel member toward the open upper end of the receptacle when the cover is removed and an expendable debris collecting bag is fitted over the receptacle to facilitate transfer of the contents of the body section into the expendable bag.

8 Claims, 8 Drawing Figures

Fig-5
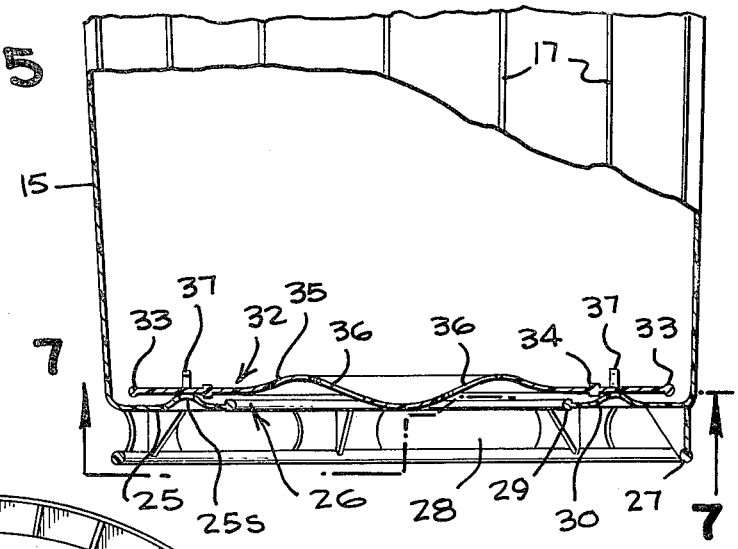
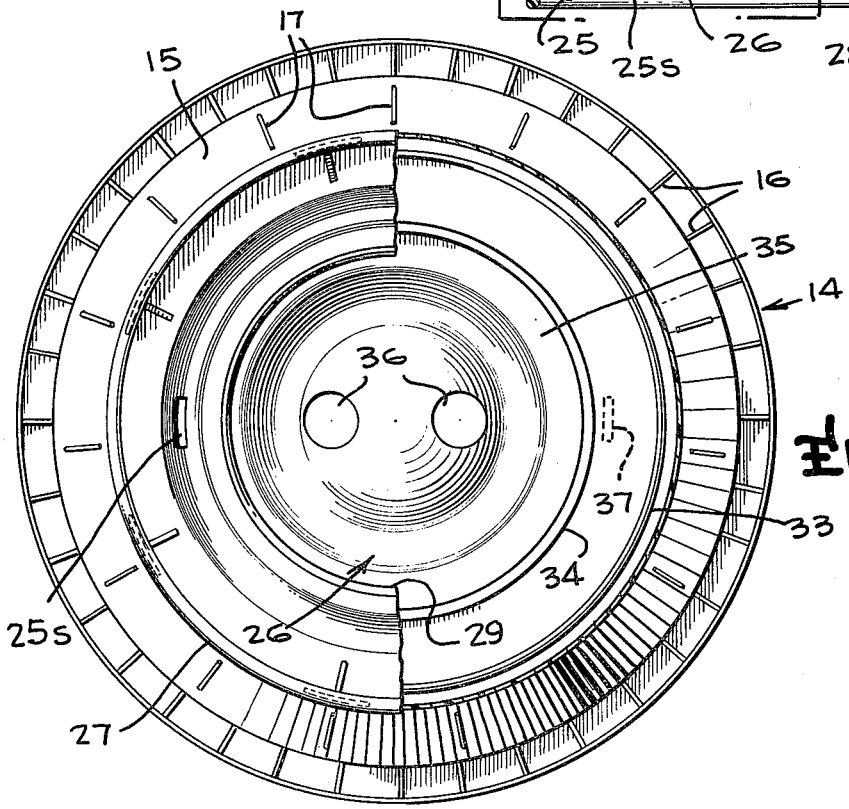
Fig-7
Fig-6
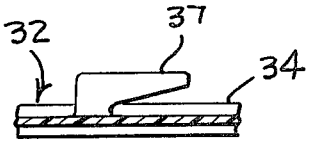
Fig-6A
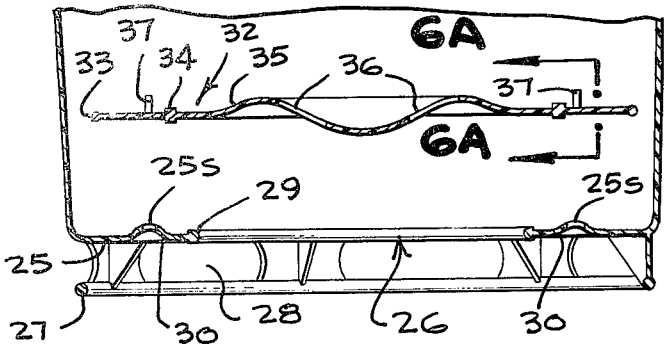

DEBRIS RECEPTACLE, COVER, AND CONTENTS COMPRESSOR AND DISCHARGE ASSEMBLY

BACKGROUND AND OBJECTS OF THE INVENTION

The present invention relates in general to portable covered refuse receptacles or containers, commonly referred to as "trash cans", and more particularly to portable covered refuse receptacles having means for compressing and assisting discharge of the contents from the receptacle into expendable trash bags and the like.

Heretofore, trash cans or refuse receptacles for collecting trash, refuse and debris have simply involved a main container or receptacle section, for example about 2' to 2½' in height, of upwardly opening cup shaped configuration, having an upwardly diverging or flaring side of truncated conical configuration with an integral or fixed bottom spanning the receptacle near the lower end thereof, frequently spaced above the lower end by a downwardly extending annular lip or bead, and having a flanged or beaded upper edge onto which a lid or closure cover fits to removably close the upper end of the receptacle section. For a long time, these lower receptacle and upper lid or cover sections were made of metal, frequently galvanized metal, but in recent years have been commonly made of molded rigid, or semi-rigid, plastic material.

In substantially all cases, the bottom of the receptacle section was a circular disk-like sheet metal or plastic bottom disk shaped section fixedly joined at its edges to the encircling side wall of the receptacle portion, and commonly thin polyethylene bags or other thin plastic liner bags have been employed as an insert liner in the receptacle to receive the refuse or debris. Frequently, problems have arisen with transferring of trash or debris from such containers when they did not use thin plastic collecting bags as liners into such trash containers, either where local municipal requirements call for trash to be collected in bags for pickup, or where it is desired by the user to retain trash in that manner. Also, it has been difficult to achieve effective transfer of the contents of the customary refuse receptacles or trash cans particularly when used for collecting lawn and garden debris into collection bags, and to achieve some compaction or compression of the contents of the container before or during the transfer operation.

An object of the present invention, therefore, is the provision of a novel portable trash or debris receptacle and cover structure which effectively overcomes many of the disadvantages referred to above associated with prior available trash receptacles.

Another object of the present invention is the provision of a novel trash or debris receptacle and cover structure, particularly for lawn and garden debris, having a manually movable piston disk forming the bottom of the receptacle which is readily movable manually when the cover is removed and the receptacle is positioned for discharge of its contents into a bag or other container, to compress the contents and thereby reduce the volume of the load while transferring the same to a trash bag or similar expandable container.

Another object of the present invention is the provision of a novel trash or debris receptacle, cover, and discharge piston bottom structure as described in the preceding paragraph, which is of durable construction capable of reasonably withstanding the hard usage customary for such structures and which is particularly convenient for collection, compression and discharge of lawn and garden debris and the like.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 5 is a fragmentary vertical section view, to enlarged scale, taken along a diametric vertical plane of the lower receptacle portion, showing the pusher bottom disk in normal position resting on the supporting ledge portions of the lower receptacle portion;

FIG. 6 is a fragmentary section view similar to FIG. 5, showing the pusher bottom disk partially displaced from its normal position toward the access or discharge opening at the upper end of the receptacle section; and FIG. 6A is a fragmentary vertical section view through the piston member, taken along the line 6A—6A of FIG. 6;

FIG. 7 is a section view of the pusher bottom disk and the associated supporting flange structure at the bottom portion of the container, taken along line 7—7 of FIG. 5.

DETAILED DESCRIPTION OF A PREFERRED EMBODIMENT

Figure 2:
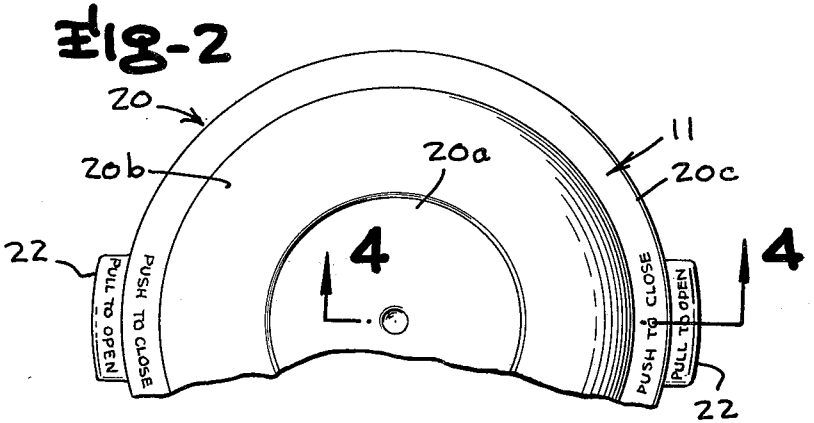
FIG. 2 is a fragmentary top plan view thereof.
Figure 3:
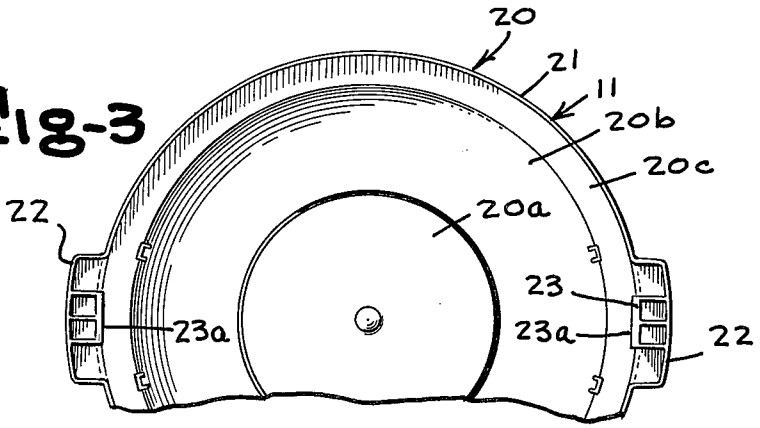
FIG. 3 is a fragmentary bottom view of the removable cover or lid.

Referring to the drawings, wherein like reference characters designate corresponding parts throughout the several figures, the present invention comprises a portable debris collecting receptacle and cover structure, of the type commonly referred to as an outdoor "trash can", which comprises as the main components a lower, upwardly opening receptacle or container section 10 and a removable lid or top closure member 11. In the illustrated embodiment, both of these components are molded of a tough, pliable, copolymer plastic. The lower receptacle or container member 10 is preferably in the shape of a large, upwardly opening, truncated conical can or cup configuration, for example having an overall height of about 32", an inner diameter of about 19" at the upper open end 12, and a diameter of about 16" at the lower end 13. The upper end 12 of the container or receptacle 10 in the illustrated embodiment has a molded lip formation 14 having transverse wall portion **14*a* extending outwardly from the inner surface of the open end 12 and then folded downwardly along portion 14*b* to follow a cylindrical path, so as to project outwardly about 1" from the inner diameter at the upper end and also about one inch downwardly toward the bottom. Between the cylindrical concentric outer portion 14*b* of the lip formation 14 and the outer surface of the truncated conical outer side wall 15 of the receptacle or container 10 are a plurality of radial fins, indicated at broken lines at 16, for example, in the form of integral webs which are, in the illustrated embodiment, about $1\frac{3}{4}''$ apart, and integrally joining the side wall 15 and the outer portion 14***b* of the lip formation as well as the annular transverse top wall portion 14*a* of the lip formation. This provides support for the lip formation and enables it to be reliably used as a handle for the receptacle or container 10.

In the illustrated embodiment, the side wall 15 of the can is about 3/32" thick, and at circumferentially spaced intervals, outwardly extending molded ribs 17 are provided, originating, for example, about 6" down from the upper end 12 of the receptacle or container section and extending downwardly to a location near the bottom, for example about 3" above the lower end 13. These ribs 17 add support to the side wall and also facilitate nesting for shipping. Preferably, the inside surface of the receptacle or container member 10 is plain, smooth and shiny without mold marks, ribs or other projections.

Figure 4:
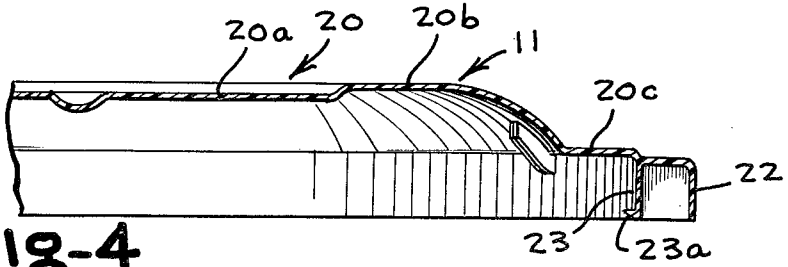
FIG. 4 is a fragmentary vertical section view through the cover or lid, taken along the line 4—4 of FIG. 2.
Figure 1:
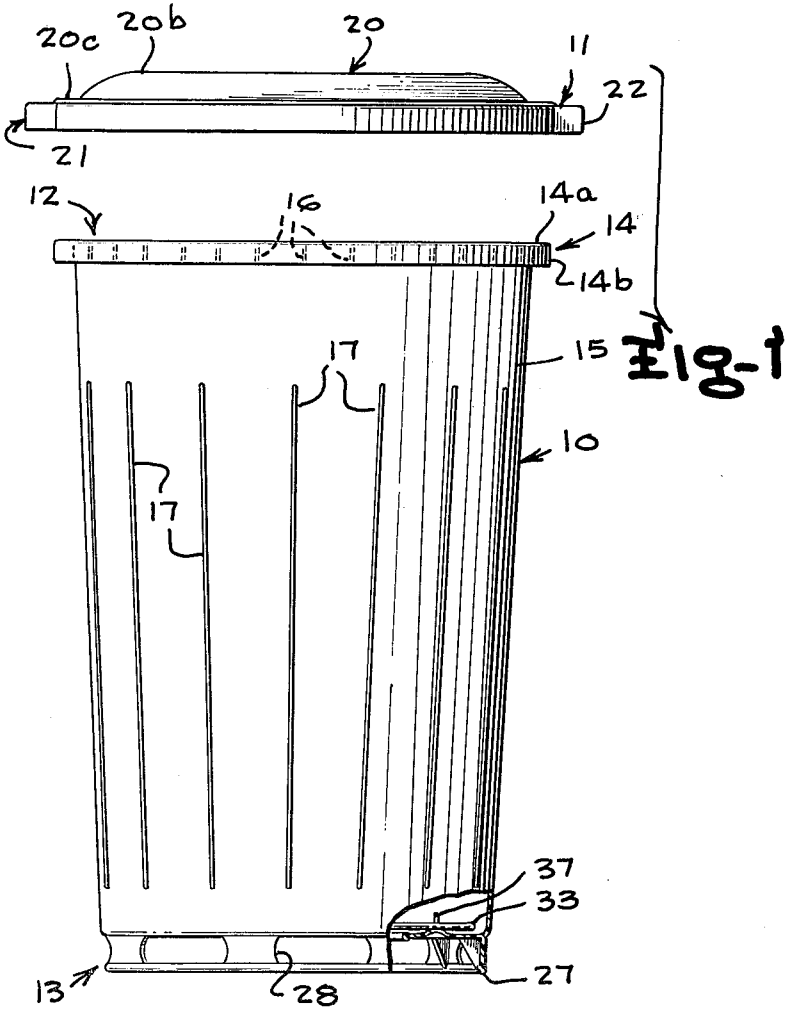
FIG. 1 is an exploded side elevation view of a portable debris receptacle and cover, with parts broken away, constructed in accordance with the present invention.

The cover or lid 11, forming the top closure member, is of substantially conventional construction in most respects, being formed of a top wall 20, for example about 3/32" thick molded from a copolymer plastic, having a 1" lip 21 projecting downwardly from the edge of the top wall 20 and having a diameter corresponding to the outer diameter of the lip formation 14 at the top of the receptacle component 10, for example about 21 1/16" inside diameter. The top wall 20 in the illustrated embodiment has a central flat or planiform zone 20*a*, which has a diameter of about 10", encircled by an annular curved zone 20*b* having a span of about $4\frac{1}{2}''$ between its inner diameter and outer diameter and having an upwardly arched profile or vertical cross-sectional configuration as shown in FIG. 4. This annular upwardly curved or bowed zone 20*b* is, in turn, encircled by a flat outer annular ring-like zone 20*c*, which may be about $1\frac{1}{4}$ between its inner and outer diameters, joining the downturned lip 21 at its outer edge. Also, in the illustrated embodiment, a pair of diametrically opposite, outwardly projecting handle formations 22 are provided, having downwardly extending hook formations 23 shaped to hook under the lower edge of the lip formation outer wall 14*b* of flange portion 14 of the receptacle section 10 to releasably hold the cover on the receptacle section. The handles and adjoining portions of the cover are sufficiently flexible so that they can be distorted upwardly to withdraw the hook portions 23*a* of the handle hook formations 23 from under the lip formation 14 for withdrawal of the cover.

The bottom portion of the receptacle or container section 10 has a novel construction which provides a manually displaceable pusher disk member which provides a discharge assist piston to facilitate compaction and discharge of the contents of the container into an expendable trash bag or the like. The bottom portion of the receptacle or container 10 includes an annular shelf or ledge formation 25 integrally formed with the side wall 15 spaced a short distance, for example about $1\frac{1}{2}''$ or 2", above the bottom edge of the container section 10, defining a center hole 26, for example about 9" in diameter, concentric with the vertical center axis of the container section 10. The bottom edge of the side wall 15 is provided with an enlarged bead formation, indicated at 27, forming a grab ring, and slots 28 forming hand holes are provided in the side wall portion between the level of the shelf or ledge formation 25 and the bottom edge grab ring 27 to receive the fingers of the user's hand. As illustrated, the preferred embodiment includes a bead formation 29 providing a small diameter annular ring at the perimeter or bounding edge of the center hole 26, and an upwardly convex arcuate deformed ring 30 concentric with the center axis of the container is located about one third of the distance between the bead 29 forming the boundary of the center hole 26 and the side wall 15, providing a raised ring-like seat on which a movable pusher disk member or discharge assist piston 32 normally rests.

The disk or piston member 32 is of only slightly smaller diameter than the inner diameter of the receptacle or container section 10 where it joins the shelf or ledge formation 25, and is provided with a circular cross-section outer bead 33, a square cross-section annular bead formation 34 of slightly smaller diameter than the diameter of the raised seating ring formation 30 which assists in centering the disk or piston 32, and in the illustrated embodiment has an undulating radial cross-section in the central portion 35 concentric with the center axis of the disk or piston member 32. Two finger holes 36 are provided spaced oppositely from the center of the disk or piston 32, and two right angle catch projections 37 are provided at appropriate locations to project through slots 25*s* in the shelf or ledge formation 25 when the disk or piston member 32 is inverted or turned over from the position illustrated in FIG. 5, to interfit in the slots 25*s* in the shelf or ledge formation 25 for releasably latching the disk or piston member 32 against the shelf or ledge formation 25.

The previously described construction provides a particularly simple and versatile receptacle construction for lawn and garden use, and the like, which readily permits extensive compaction or compression of the debris in the receptacle portion and discharge into a disposable trash bag. For example, leaves, sticks, rocks, thorns and other types of lawn debris can be raked or collected by other conventional tools into piles about the lawn and garden area, and lifted into the receptacle or container section 10 when it is disposed in the normal upright position with the bottom disk or piston member 32 in place at the bottom of the receptacle. The debris is packed, jammed or compressed manually into the receptacle without using a trash bag, and when full, a lawn and garden trash bag or other desired disposable or expendable bag of a size to fit over the receptacle is placed upside down on the receptacle, with the bag in bottom up position, until the open edge of the bag substantially reaches the ground. The receptacle section 10 is then tipped over to lie sidewise on the ground, and the grab ring bottom structure formed by the bead 27 and hand holes 28 are grasped to raise the receptacle section 10 to the upside down position, still encircled by the disposable lawn trash bag. The disk or discharge assist piston member 32 is then manually reached through the push hole 26 in the bottom of the receptacle or container section 10 and the section 10 is lifted while pushing downwardly on the disk or discharge assist piston member 32. The compressed debris will thus be retained in the compressed condition while being discharged into the disposable lawn trash bag, which can be closed in the usual manner after complete removal of the receptacle 10 and disk or discharge assist piston member 32.

By virtue of this construction, the operator does not have to lift a loaded trash receptacle, nor does he have to try to pull a stuffed compressed trash bag from a receptacle, which may require several lifts or shaking and may be difficult to accomplish if the debris in any way distorts the configuration of the usual receptacle.

Nor does the operator have to try to jam sticks, thorns and debris into a disposable lawn bag that either will not stay open, or tears, or will not accommodate compressing of the debris. The disk or discharge assist piston member 32 easily releases the debris from the receptacle into the disposable bag. Alternatively, the disk or discharge assist piston can be secured in the bottom of the can by engagement of the catch projections 37 in the slots 25*s* in the shelf or ledge formation 25 permitting its use as an ordinary trash receptacle or container and the structure is such that the openings provided in the bottom structure will not retain water and thus will avoid accumulation of weight to the waste debris which can occur when water accumulates in ordinary trash containers.

We claim:

1. A receptacle and cover assembly for collecting lawn debris and the like and including means for assisting transfer of the contents to expendable lawn trash bags and the like, comprising a main receptacle body section in the shape of an upwardly opening container having a lateral side wall terminating in a lip formation at the upper end thereof bounding the top opening and a lower edge formation at the bottom of the receptacle body section for supporting the same in upright position on a supporting surface, a removable cover member for said receptacle body section, the body section having a centrally open outer bottom wall portion extending inwardly from the side wall at a position spaced slightly above said lower edge formation defining an inwardly projecting shelf-like ledge extending inwardly from the side wall as an encircling formation bounding the center opening thereof, a moveable bottom panel member forming a discharge assist piston providing collectively with said outer bottom wall portion the bottom of the receptacle having its outer peripheral portions overlying the shelf-like ledge formation and collectively therewith forming the bottom of the receptacle, the center opening in said bottom wall portion being large enough for passage of the operator's hand therethrough to manually engage and force said bottom panel member from the bottom wall portion of said receptacle body section toward the open upper end thereof when the cover is removed and an expendable debris collecting bag is fitted over the receptacle body portion to facilitate transfer of the contents of the body section into the expendable bag, said receptacle body portion and said bottom wall portion being formed of resiliently deformable molded plastic material, said bottom panel member having catch formations integrally formed thereon, and said bottom wall portion having integrally formed slots for receiving and releasably interlocking with said catch formations for releasably restraining the bottom panel member latched to the bottom wall portion.

2. A refuse receptacle and cover assembly as defined in claim 1, wherein said main receptacle body section is of tapered cylindrical configuration tapering to a lesser diameter at said bottom edge, said bottom panel member is a thin circular disk, and said outer bottom wall portion is an annular ledge providing a center opening whose diameter is about half the diameter of the outer portion of said bottom wall formation.

3. A debris receptacle and cover assembly as defined in claim 2, wherein the portions of said lower edge portion adjacent the bottom edge of the main receptacle body section below the level of said bottom wall portion include a plurality of circumferentially elongated slot-like openings forming hand holes to receive fingers of the operator facilitating grasping and manipulation of the receptacle body section.

4. A debris receptacle and cover assembly as defined in claim 3, wherein said annular ledge formed by said bottom wall portion includes an annular upwardly convex intermediate deformation spaced radially outwardly of the perimeter of the center opening between said perimeter and the outer portions of the annular ledge formation providing a raised annular contact surface for supporting the circular disk along an annular zone spaced inwardly from the perimeter of the disk.

5. A debris receptacle and cover assembly as defined in claim 4, wherein said cover member has a pair of radially outwardly projecting, diametrically opposite handle formations extending outwardly from the circular perimeter thereof and having downwardly extending latch hook formations integral therewith normally urged to releasably latch beneath the upper lip of said main receptacle body section and being resiliently deformable upon upward deforming forces on said handle formations to release the same from latching relation with said upper lip formation.

6. A debris receptacle and cover assembly as defined in claim 2, wherein said annular ledge formed by said bottom wall portion includes an annular upwardly convex intermediate deformation spaced radially outwardly of the perimeter of the center opening between said perimeter and the outer portions of the annular ledge formation providing a raised annular contact surface for supporting the circular disk along an annular zone spaced inwardly from the perimeter of the disk.

7. A debris receptacle and cover assembly as defined in claim 2, wherein the cover member and the main receptacle body section are both formed of resiliently deformable flexible plastic material, and said cover member having a pair of radially outwardly projecting, diametrically opposite handle formations extending outwardly from the circular perimeter thereof and having downwardly extending latch hook formations integral therewith normally urged to releasably latch beneath the upper lip formation of said main receptacle body section and being resliently deformable upon upward deforming forces on said handle formations to release the same from latching relation with said upper lip formation.

8. A debris receptacle and cover assembly as defined in claim 1, wherein the portions of said lower edge formation adjacent the bottom of the main receptacle body section below the level of said bottom wall portion include a plurality of circumferentially elongated slot-like openings forming hand holes to receive fingers of the operator facilitating grasping and manipulation of the receptacle body section.

* * * * *